US012352019B2

(12) United States Patent
Wenger

(10) Patent No.: US 12,352,019 B2
(45) Date of Patent: Jul. 8, 2025

(54) HYDRANT, METHOD FOR DISASSEMBLY OF A SPINDLE ARRANGEMENT FROM A HYDRANT AND METHOD FOR ASSEMBLY OF A SPINDLE ARRANGEMENT IN A HYDRANT

(71) Applicant: VONROLL INFRATEC (INVESTMENT) AG, Emmenbrucke (CH)

(72) Inventor: Sascha Wenger, Oensingen (CH)

(73) Assignee: VONROLL INFRATEC (INVESTMENT) AG, Emmenbrucke (CH)

( * ) Notice: Subject to any disclaimer, the term of this patent is extended or adjusted under 35 U.S.C. 154(b) by 0 days.

(21) Appl. No.: 18/039,744

(22) PCT Filed: Dec. 1, 2020

(86) PCT No.: PCT/EP2020/084008
§ 371 (c)(1),
(2) Date: Jun. 1, 2023

(87) PCT Pub. No.: WO2022/117174
PCT Pub. Date: Jun. 9, 2022

(65) Prior Publication Data

US 2024/0052609 A1 Feb. 15, 2024

(51) Int. Cl.
*E03B 9/08* (2006.01)

(52) U.S. Cl.
CPC ..... *E03B 9/08* (2013.01)

(58) Field of Classification Search
CPC ..... E03B 9/02; E03B 9/08; Y10T 137/6106
See application file for complete search history.

(56) References Cited

U.S. PATENT DOCUMENTS

| | | | | |
|---|---|---|---|---|
| 726,369 | A * | 4/1903 | Sullivan | E03B 9/04 251/266 |
| 3,672,393 | A * | 6/1972 | Klassen | E03B 9/08 137/551 |
| 4,440,190 | A | 4/1984 | Barbe | |

FOREIGN PATENT DOCUMENTS

| | | | |
|---|---|---|---|
| CH | 701381 | B1 | 1/2011 |
| DE | 2508792 | A1 | 9/1975 |
| DE | 4243756 | A1 | 7/1994 |
| GB | 1494422 | A | 12/1977 |
| NL | 2013336 | B1 * | 9/2016 |

OTHER PUBLICATIONS

NL 2013336 translation.*
International Search Report with Translation and Written Opinion for PCT application No. PCT/EP2020/084008, mailed Aug. 5, 2021.
International Application Status Report generated May 26, 2023.

* cited by examiner

*Primary Examiner* — Kevin F Murphy
(74) *Attorney, Agent, or Firm* — Notaro, Michalos & Zaccaria P.C.

(57) ABSTRACT

A hydrant has a riser pipe and a main valve. The main valve comprises a main valve body, a sealing seat which can be sealed with respect to the main valve body, a valve rod connected at one end to the main valve body, and a spindle arrangement. The spindle arrangement contains a journal/journal support arrangement, comprising at least one journal and at least one journal support arrangement, wherein the journal support arrangement has a first support and a second support against each of which the journal can be brought into contact.

11 Claims, 9 Drawing Sheets

Figure 1:
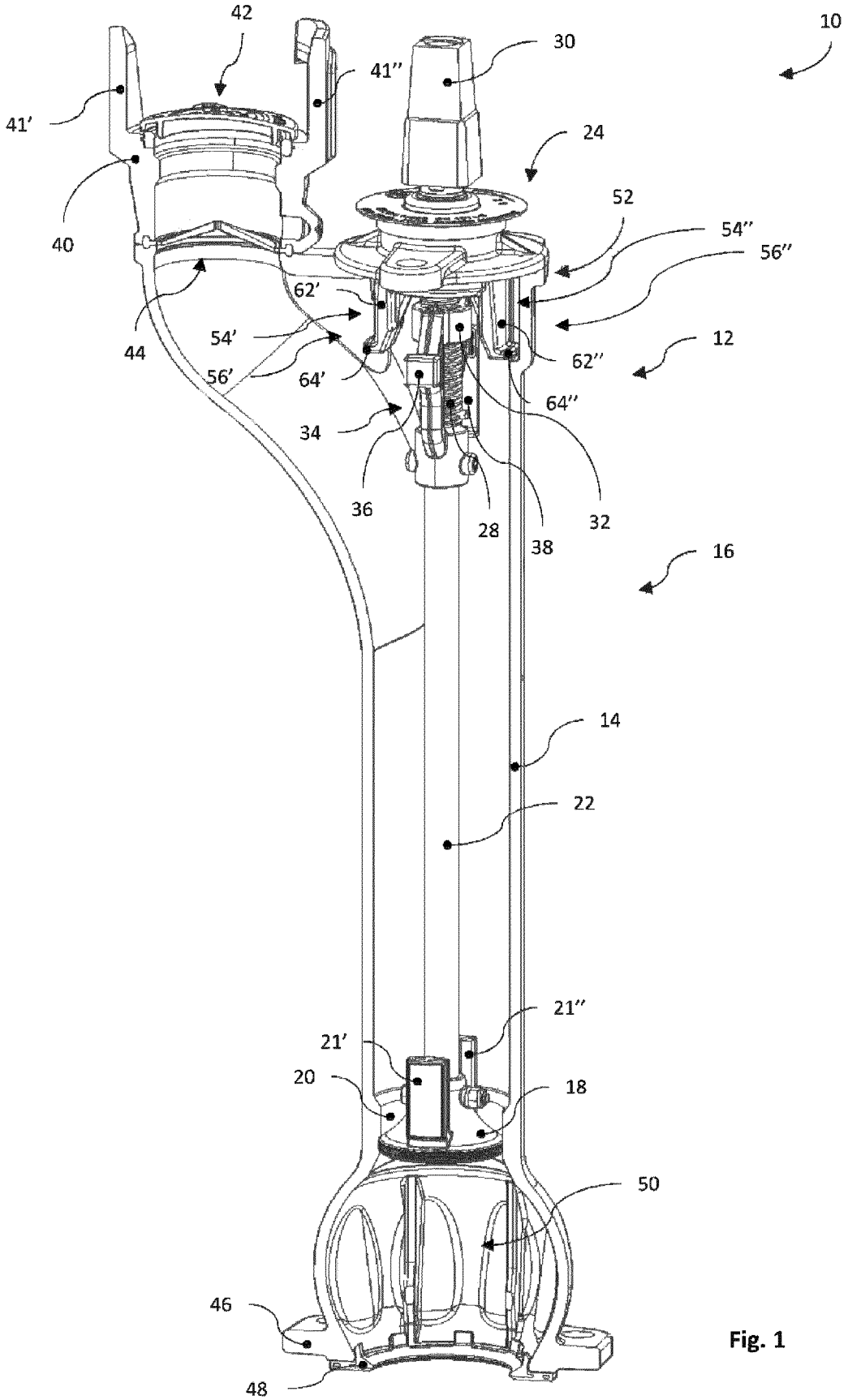

HYDRANT, METHOD FOR DISASSEMBLY OF A SPINDLE ARRANGEMENT FROM A HYDRANT AND METHOD FOR ASSEMBLY OF A SPINDLE ARRANGEMENT IN A HYDRANT

The present invention relates to a hydrant, to a method for removing a spindle assembly from a hydrant, and to a method for installing a spindle assembly in a hydrant.

Hydrants are connected to a water distribution system and form a fitting for drawing water, in order to enable the fire brigade as well as public and private users to draw water from the public water distribution system. The network pressure in the water distribution system is typically around 6 to 9 bar. A distinction is generally made between above-ground hydrants and underground hydrants. The above-ground hydrant is permanently installed above ground and has outlets with standardized couplings. The underground hydrant is installed underground and is covered from above by a ground cover. The underground hydrant is therefore a water drawing point which is situated below ground level and is closed by the ground cover.

Hydrants comprise a riser pipe having an interior and an exterior, the interior opening into the connection for drawing water. To open and close hydrants, the hydrants are provided with a main valve comprising a main valve body and a sealing seat which can be sealed by the main valve body. The main valve body is connected to one end of a valve rod, by which the main valve body can be moved axially up and down. To this end, a spindle assembly is provided, comprising a spindle cover which can be fastened to the riser pipe, a spindle which is rotatably mounted on the spindle cover, and a spindle nut which is coupled to the valve rod at another end. The spindle and the spindle nut are in thread engagement with each other. The spindle assembly converts a torque applied to the spindle into an axial movement of the valve rod and thus of the main valve body.

Over time, the hydrant will require inspection, e.g. inspection of the main valve, replacement of the main valve body, cleaning of the valve seat, replacement of other built-in parts, etc.

To remove the spindle assembly and/or the main valve, it is known to disconnect the hydrant from the water supply, for example by using an upstream shut-off member, e.g. a slider, to cut off the water supply. As soon as there is no longer any water pressure at the hydrant, the spindle cover is loosened from the riser pipe, for example by loosening screws. The spindle assembly and/or the main valve could then be taken out of the riser pipe in the upward direction by applying a pulling force to the spindle cover, for example. However, the main valve body is in sealing contact with the sealing seat.

This problem is known in the prior art and occurs particularly in hydrants in which the main valve is sealed to the sealing seat by radial compression.

Methods for removing the spindle assembly and/or the main valve from the hydrant are known, in which screws are applied between the riser pipe and the spindle cover. The spindle assembly is then rotated by way of its coupling element, for example an operating square, in order thus to pull the main valve body out of the sealing seat.

Known methods for installing the spindle assembly and/or the main valve in the hydrant are similarly troublesome. Here, use is made of separate, extended screws which are inserted through screw holes in the spindle cover and are screwed into threads in the riser pipe. The spindle cover is then gradually lowered and brought closer to the riser pipe by tightening the screws. Here, the screws must be turned in an alternating fashion to avoid tilting.

One disadvantage of methods known in the prior art for removing or installing the spindle assembly and/or the main valve as mentioned above is that these methods are complicated and time-consuming, may lead to tilting, and make it necessary to carry separate tools and screws. The work also has to be carried out on areas of the hydrant that are usually difficult to access.

The problem addressed by the present invention is that of specifying a hydrant, a method for removing a spindle assembly from a hydrant and a method for installing a spindle assembly in a hydrant, which do not have the aforementioned disadvantages.

This problem is solved by a hydrant having the features specified in claim 1. Advantageous embodiment variants as well as a method for removing a spindle assembly from a hydrant and a method for installing a spindle assembly in a hydrant are specified in further claims.

A hydrant according to the invention comprises a riser pipe and a main valve, the main valve having a main valve body, a sealing seat which can be sealed by the main valve body, a valve rod which is connected at one end to the main valve body, and a spindle assembly. The spindle assembly comprises a spindle cover which can be fastened to the riser pipe, a spindle which is rotatably mounted on the spindle cover, and a spindle nut which is coupled to the valve rod at another end. The spindle and the spindle nut are in thread engagement with each other, designed to convert a torque applied to the spindle into an axial movement of the valve rod. The spindle assembly additionally includes a journal/journal support assembly, comprising at least one journal and at least one journal support, wherein the journal support comprises a first support and a second support, against each of which the journal can be brought to bear.

The hydrant according to the present invention is characterized in that the spindle assembly and/or the main valve can be removed from the riser pipe and can likewise be installed in the riser pipe by way of the spindle cover without a separate tool. In addition, the respective procedures necessary for this are self-explanatory and can be carried out quickly and easily on site. Furthermore, the procedures can advantageously be carried out quickly and easily even on hydrants that are difficult to access.

The riser pipe is provided with at least one journal support which comprises a first and a second support. Formed in turn on the spindle cover is at least one journal which can be brought to bear against the first and the second support. As soon as the journal is placed against a corresponding one of the support, the spindle can be rotated in a direction in which the spindle assembly and/or the main valve either is pushed upward, in order to pull the main valve body out of the sealing seat, or is pushed downward, in order to press the main valve body into the sealing seat. To this end, the rotational movement is converted into the necessary translational movement by means of the spindle assembly. The force thus generated is introduced into the respective support in the riser pipe via the journal of the spindle cover. In counter-reaction, as rotation of the spindle continues, the spindle nut is moved axially and thus the valve rod and the main valve body are moved axially. As the main valve body is raised, it increasingly comes out of the fixed bearing or radial compression against the sealing seat until a height is reached at which the main valve body is freed from the sealing seat. The spindle can be rotated via an outwardly extending coupling element, e.g. an operating square, which is connected to the spindle for co-rotation therewith.

In this state, the main valve can be taken out of the riser pipe in the upward direction. In the context of the present application, "taking the main valve out of the riser pipe" means taking out an assembly comprising: the main valve body, the valve rod connected thereto, the spindle assembly coupled to the other end of the valve rod, and the spindle cover coupled to the spindle in such a way as to be able to be rotated by the latter. This assembly is sometimes also referred to as a "linkage".

The main valve can be reinstalled in the riser pipe reciprocally. The main valve body is simply pressed into the sealing seat by rotating the spindle.

In a surprisingly simple and hitherto unknown manner, the spindle assembly already installed in the hydrant, in conjunction with the journal/journal support assembly, is used or "repurposed" to convert a rotational movement applied to the spindle into a force between the spindle cover and the riser pipe. This force is dissipated into the spindle nut of the spindle assembly, with the result that the spindle nut, the valve rod and the main valve body can be moved axially. The main valve body is thus either raised or lowered, depending on the direction of rotation of the spindle. To rotate the spindle, use can be made of a hydrant key, for example, by which hydrants are usually opened and closed. Such a hydrant key is always carried in any case for all work in connection with hydrants and does not need to be stored separately.

In one preferred embodiment of the hydrant, the first support and the second support are offset from each other. The first support and the second support may be offset from each other as viewed in the axial direction of the riser pipe. The first support and the second support may be spaced apart from each other, again as viewed in the axial direction of the riser pipe. By turning the spindle cover, e.g. to a certain height in the axial direction to which turning is possible, it is possible to select, for example, whether the journal is brought to bear against a support which is associated with removal, or whether the journal is brought to bear against the other support, which is associated with installation.

In one preferred embodiment of the hydrant, the journal is attached to the spindle cover and the journal support is provided in the riser pipe.

In one preferred embodiment of the hydrant, the journal can be brought to bear against the first support from below and the journal can be brought to bear against the second support from above. As soon as the journal is brought to bear against the second support, a force can be introduced into the latter from above (by rotating the spindle in one direction). In counter-reaction, the main valve body is moved upward. Conversely, as soon as the journal is brought to bear against the first support, a force can be introduced into the latter from below (by rotating the spindle in the opposite direction). In counter-reaction, the main valve body is moved downward.

In one preferred embodiment of the hydrant, the riser pipe is provided with a journal guide, in which the journal can be guided, wherein the journal guide comprises: a first guide section, in which the journal can be guided in the axial direction of the spindle, wherein the first guide section is at least partially bounded in the upward direction by the first support, and a second guide section, in which the journal can be guided in the axial direction of the spindle, wherein the second guide section is at least partially bounded in the downward direction by the second support.

In one preferred embodiment of the hydrant, the first and the second guide section are at least partially offset from each other. The first and the second guide section may be offset from each other as viewed in the axial direction of the riser pipe.

In one preferred embodiment of the hydrant, the first and the second guide section are at least partially overlapped in a section between the first and the second support. The journal may be moved upward via the first guide section. In a section in which the first and the second guide section are at least partially overlapped, the spindle cover can be turned so that the journal enters the second guide section. Once transferred there, the journal can be moved downward by reversing the direction of rotation of the spindle, until the journal comes into contact with the second support. As soon as the journal is brought to bear against the second support, a force can be applied to the latter from above. By continued rotation, this force is dissipated into the spindle nut, with the result that the main valve body is moved upward.

Conversely, the journal can be transferred from the second guide section to the first guide section. Once there, the journal can be brought into contact with the first support from below. As soon as the journal is brought to bear against the first support, a force can be applied to the latter from below. By continued rotation, this force is dissipated into the spindle nut, with the result that the main valve body is moved downward.

In one preferred embodiment of the hydrant, the journal guide in the riser pipe is designed as a cutout. The journal guide may be in the form of a cutout or groove made in the material of the riser pipe.

In one preferred embodiment of the hydrant, the journal is substantially L-shaped, comprising a projection which is directed outward as viewed in the radial direction of the spindle cover, wherein the projection can be brought to bear against the first and the second support. In another preferred embodiment, the projection engages in the journal guide. The projection engages in the first and the second guide section of the journal guide and is reliably axially guided therein.

The projection forms a counter-bearing, via which the journal of the spindle cover can be brought to bear against the first or the second support and a force can be introduced.

In one preferred embodiment of the hydrant, the riser pipe is open in the upward direction in the region of the second guide section. The spindle assembly can easily be taken out of the riser pipe in the upward direction through the opening.

In one preferred embodiment of the hydrant, the spindle cover can be screwed onto the riser pipe.

The invention also relates to a method for removing a spindle assembly from a hydrant according to a method comprising the steps:

- loosening the spindle cover from the riser pipe,
- rotating the spindle in a direction to raise the spindle cover to a predetermined height,
- rotating the spindle in a direction to lower the spindle cover,
- continuing to rotate the spindle in the same direction and thereby introducing into the second support, via the journal, a force that is generated by the continued rotation of the spindle,
- taking the spindle assembly out of the riser pipe.

The predetermined height may be a height of the spindle cover above which the spindle cover can be rotated or turned such that the journal can be at least partially aligned with the second support, as viewed in the axial direction of the riser pipe. By means of e.g. friction between the spindle cover and the spindle, when the spindle is rotated in the direction to lower the spindle cover, the spindle cover can be entrained or rotated therewith such that the journal can be aligned with the second support, as viewed in the axial direction of the riser pipe. The spindle cover can thus rotate by the applied rotation, so that the spindle cover does not have to be turned by hand. Alternatively, the spindle cover can also be turned by hand such that the journal is aligned with the second support, as viewed in the axial direction of the riser pipe.

The invention relates to a method for removing a spindle assembly from a hydrant according to a method comprising the steps:

loosening the spindle cover from the riser pipe, rotating the spindle in a direction to raise the spindle cover to a predetermined height, rotating the spindle in a direction to lower the spindle cover, continuing to rotate the spindle in the same direction and thereby introducing into the second support, via the journal, a force that is generated by the continued rotation of the spindle, taking the spindle assembly out of the riser pipe.

Here, too, the predetermined height may be a height of the spindle cover above which the spindle cover can be rotated or turned such that the journal can be at least partially aligned with the second support, as viewed in the axial direction of the riser pipe. By rotating the spindle in the direction to lower the spindle cover, the spindle cover can be entrained by this rotation or rotated therewith such that the journal can be aligned with the second support, as viewed in the axial direction of the riser pipe. Alternatively, the spindle cover can also be turned by hand such that the journal is aligned with the second support, as viewed in the axial direction of the riser pipe.

The invention also relates to a method for installing a spindle assembly in a hydrant according to a method comprising the steps:

at least partially inserting the spindle assembly into the riser pipe, rotating the spindle in a direction to raise the spindle cover, continuing to rotate the spindle in the same direction and thereby introducing into the first support, via the journal, a force that is generated by the continued rotation of the spindle, in a state in which the main valve body is brought at least partially into sealing contact with the sealing seat of the riser pipe, rotating the spindle in a direction to lower the spindle cover, continuing to rotate the spindle in the same direction until the spindle cover comes into contact with the riser pipe, fastening the spindle cover to the riser pipe.

After the step of at least partially inserting the spindle assembly into the riser pipe by lowering the spindle assembly into the riser pipe, the method may comprise the following steps: orienting the spindle cover such that the journal is at least partially aligned with the second support, as viewed in the axial direction of the riser pipe; lowering the spindle assembly further; turning the spindle cover such that the journal is at least partially aligned with the first support, as viewed in the axial direction of the riser pipe. The spindle cover can thus be "threaded in" by means of the journal such that the journal can be at least partially aligned with the first support, as viewed in the axial direction of the riser pipe. The at least partial insertion of the spindle assembly into the riser pipe can take place by lowering the spindle assembly into the riser pipe.

The invention relates to a method for installing a spindle assembly in a hydrant according to a method comprising the steps:

at least partially inserting the spindle assembly into the riser pipe, rotating the spindle in a direction to raise the spindle cover, continuing to rotate the spindle in the same direction and thereby introducing into the first support, via the journal, a force that is generated by the continued rotation of the spindle, in a state in which the main valve body is brought at least partially into sealing contact with the sealing seat of the riser pipe, rotating the spindle in a direction to lower the spindle cover, continuing to rotate the spindle in the same direction until the spindle cover comes into contact with the riser pipe, fastening the spindle cover to the riser pipe.

After the step of at least partially inserting the spindle assembly into the riser pipe, the method may comprise the following steps: inserting the spindle cover via the journal into the second guide section; in a section in which the first and the second guide section overlap, turning the spindle cover such that the journal is transferred from the second guide section to the first guide section. The spindle cover can thus be "threaded in" by means of the journal such that the journal can be at least partially aligned with the first support, as viewed in the axial direction of the riser pipe. The at least partial insertion of the spindle assembly into the riser pipe can take place by lowering the spindle assembly into the riser pipe.

The steps for removing the spindle assembly from the hydrant or installing it in the hydrant are self-explanatory or quickly learnable even for untrained operating personnel. The steps can easily be carried out even on hydrants that are difficult to access, for example underground hydrants. In addition, there is no need for any separate tool to be stored.

In one preferred embodiment of the hydrant, the journal is attached to the riser pipe and the journal support is provided in the spindle cover.

It is expressly pointed out that the embodiment variants above can be combined as desired. The only combinations of embodiment variants that are excluded are those that would lead to contradictions as a result of being combined.

Figure 2A:
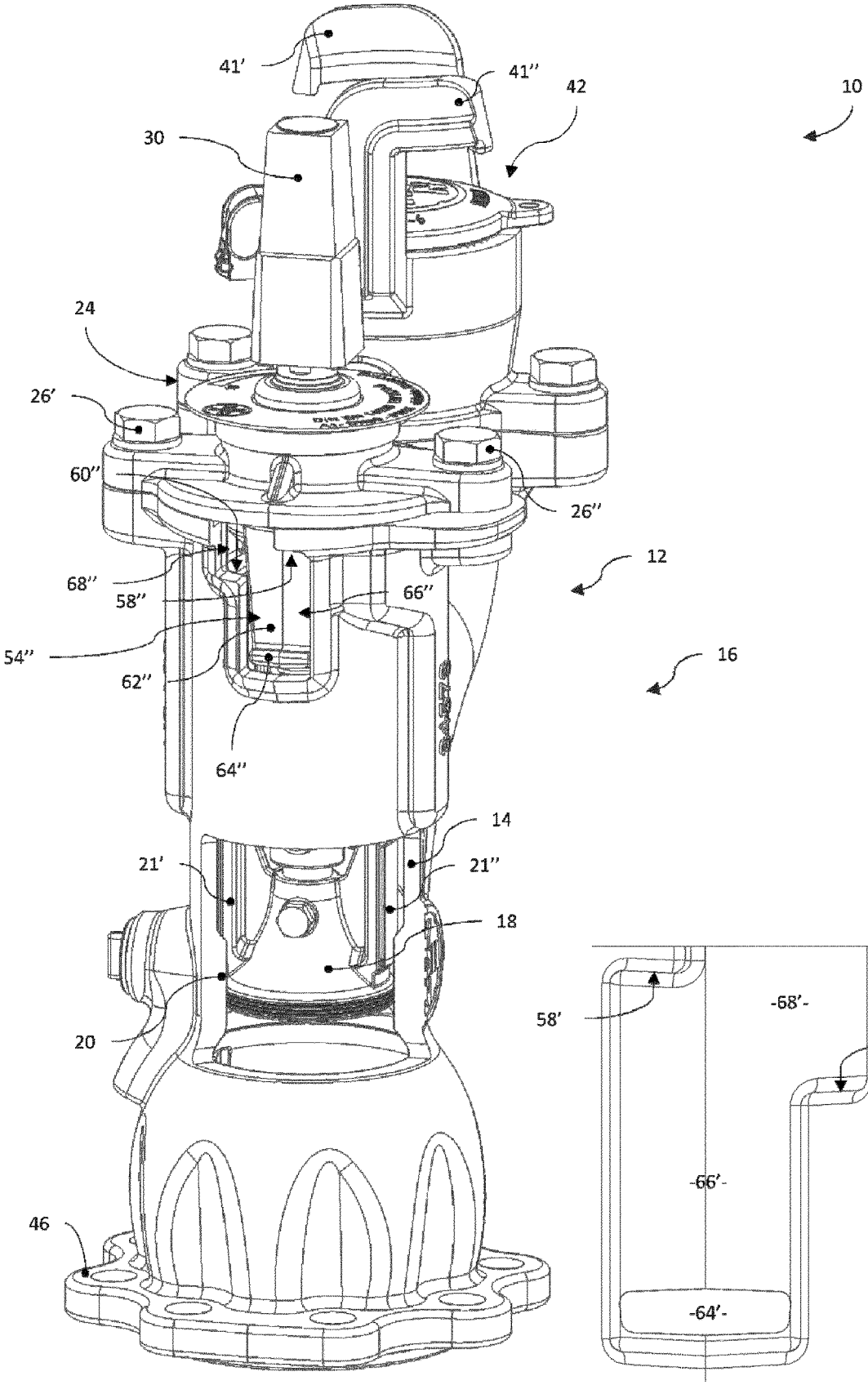
Figure 2B:
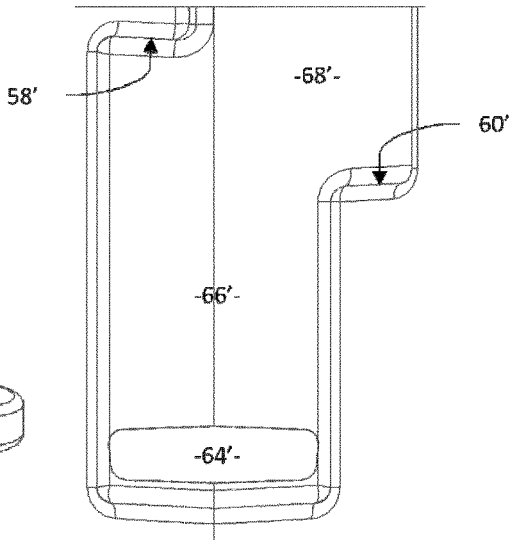
Figures 3A, 3B:
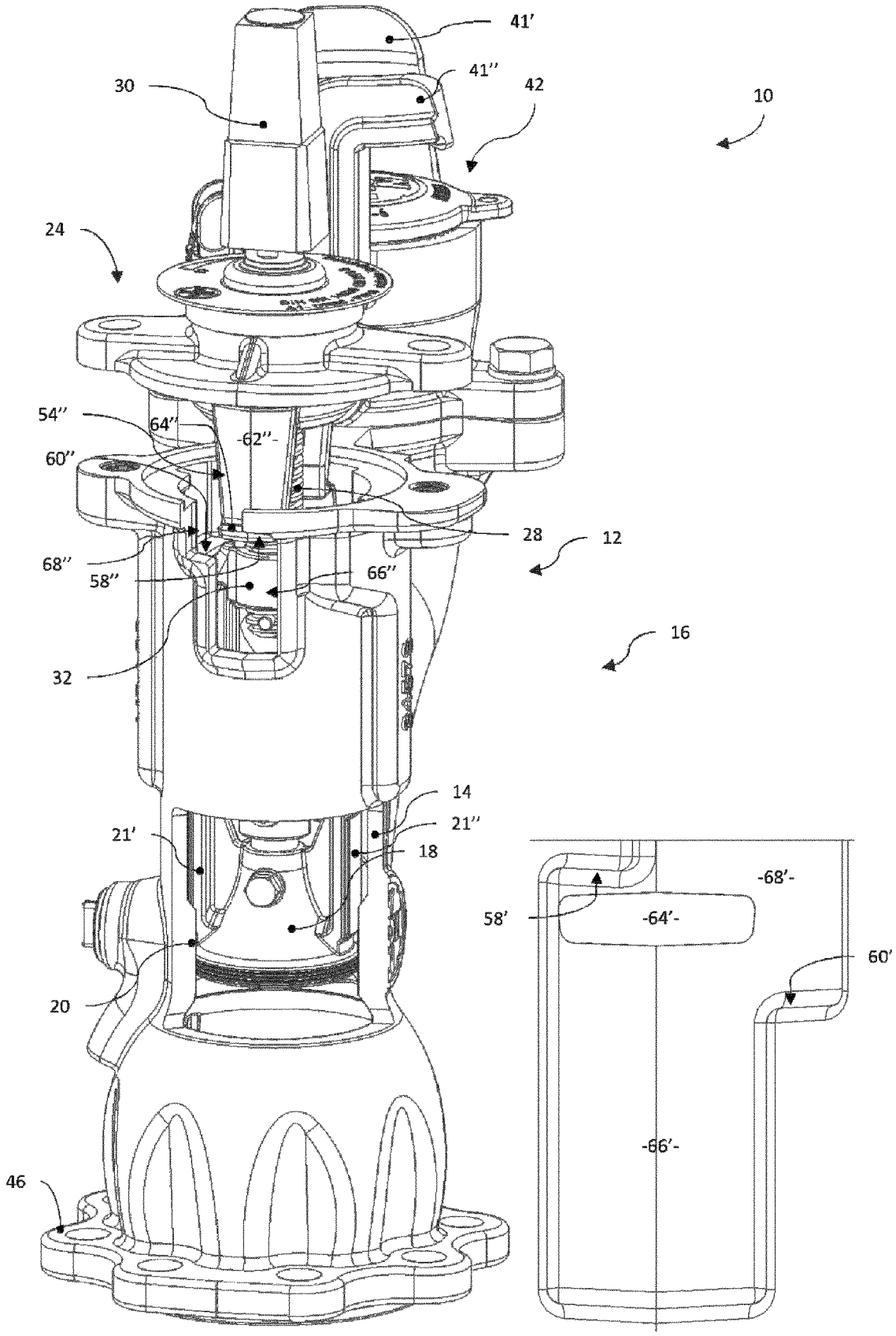
Figures 4A, 4B:
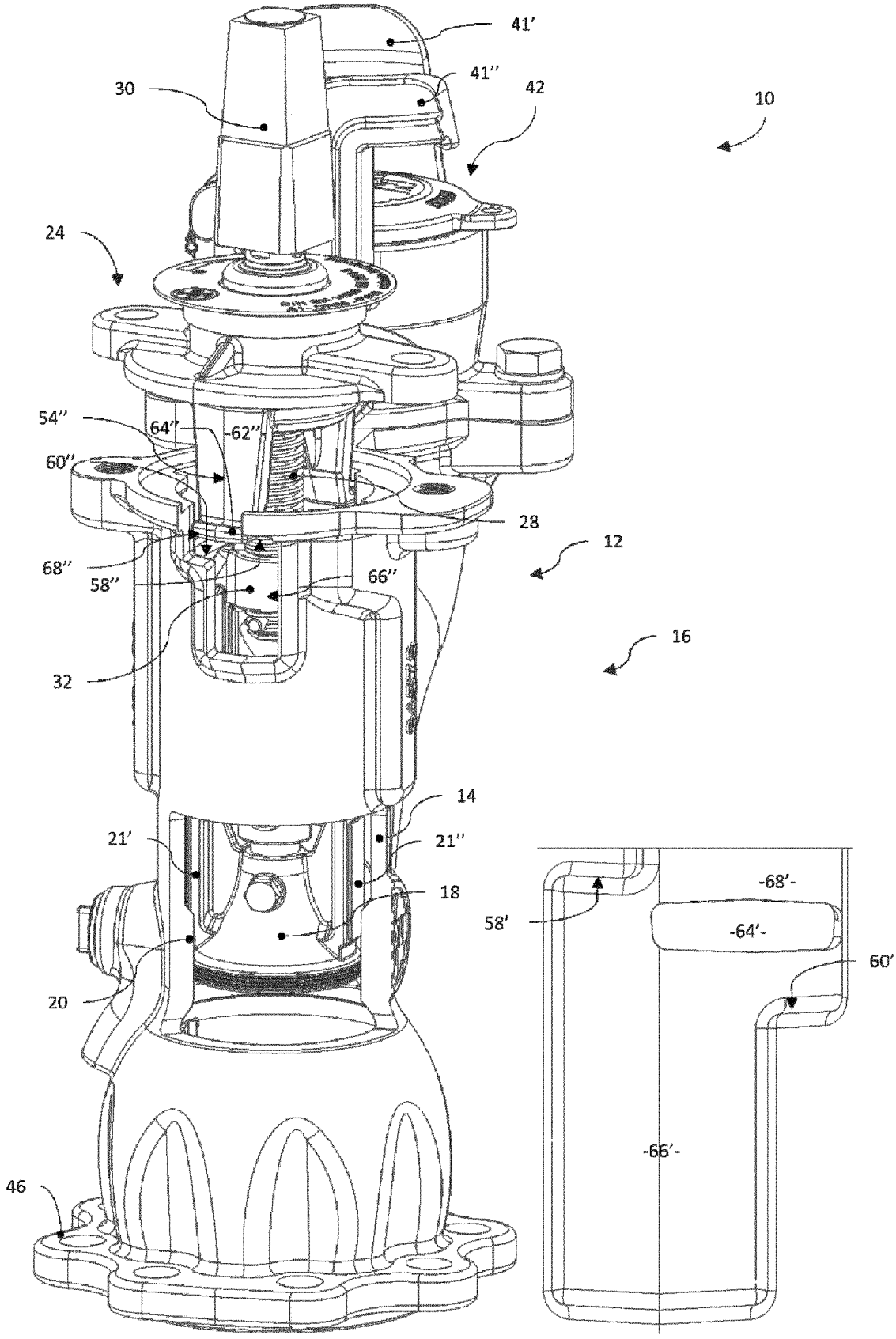

The present invention will be explained in greater detail below, inter alia with reference to procedures shown in the drawing for removing a spindle assembly from an underground hydrant and for installing the spindle assembly in the underground hydrant. In the drawing:

FIG. 1 shows a sectional view through a hydrant in the longitudinal direction, the hydrant being designed as an underground hydrant, FIGS. 2*a, b* show a partial sectional view of an underground hydrant, which is shown shortened for better clarity (FIG. 2*a*), as well as a sectional view in the region of a journal/journal support assembly to illustrate a respective position of a projection of a journal of a spindle cover (FIG. 2*b*), the spindle cover being screwed onto a riser pipe of the underground hydrant, FIGS. 3*a, b* show a view according to FIGS. 2*a, b* to explain a procedure for removing a spindle assembly from the hydrant, wherein the spindle cover is loosened from the riser pipe of the underground hydrant and is raised with respect to the riser pipe by rotating a spindle of the underground hydrant, FIGS. 4*a, b* show a view according to FIGS. 2*a, b* to explain a procedure for removing the spindle assembly from the hydrant, wherein the spindle cover is turned in the clockwise direction relative to the illustration in FIGS. 3*a, b,*

Figures 5A, 5B:
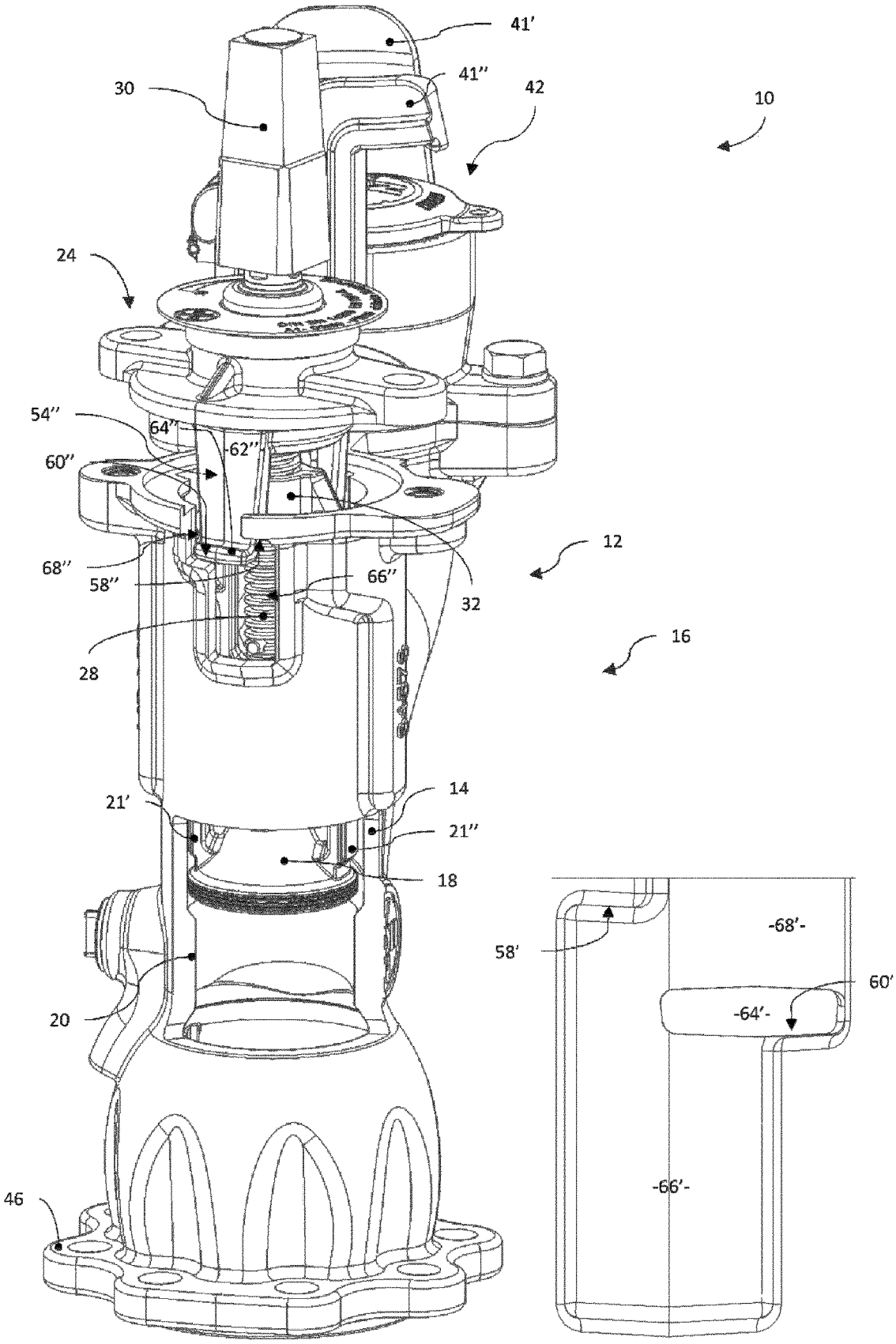
Figure 6:
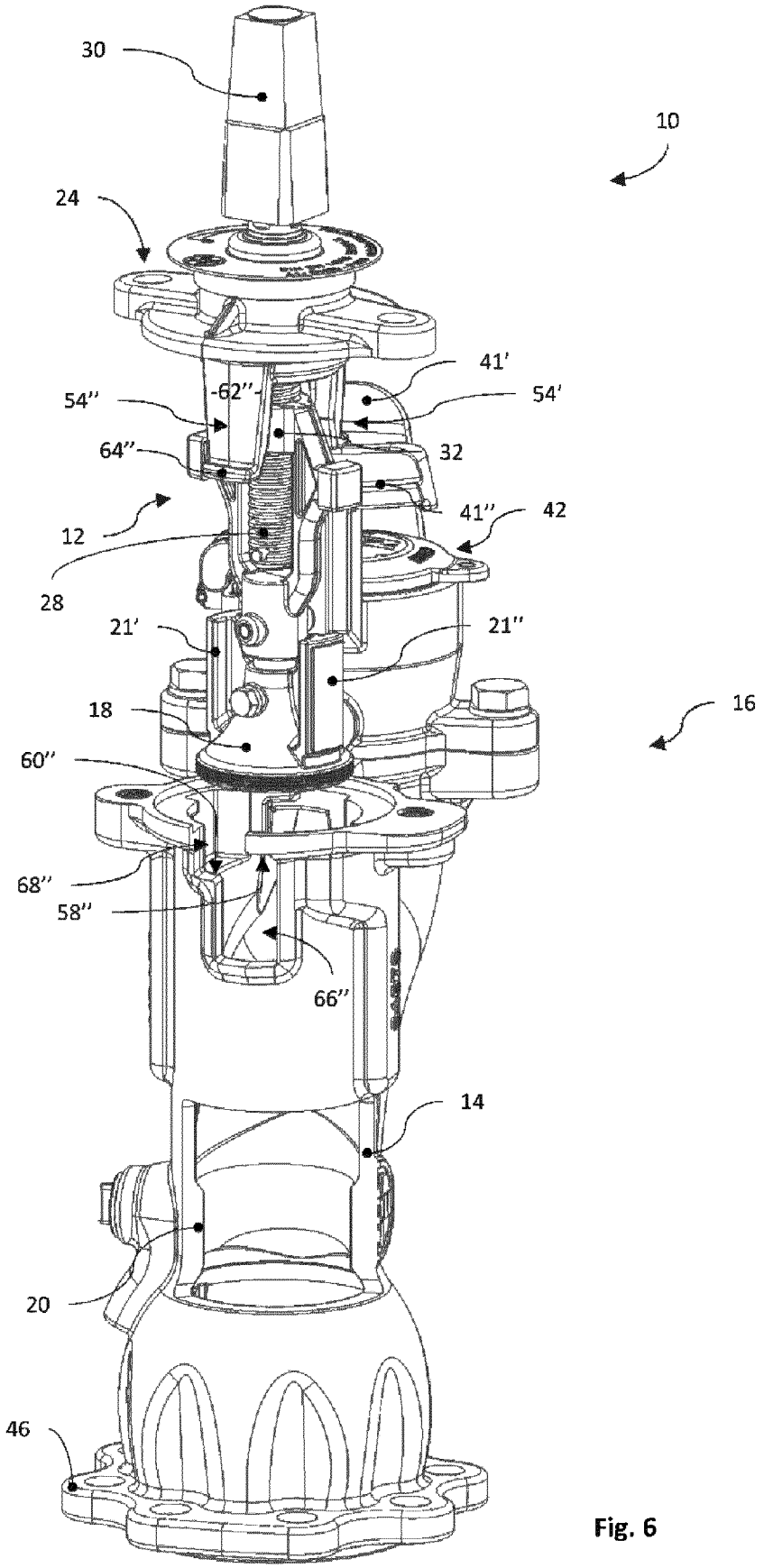
Figure 7A:
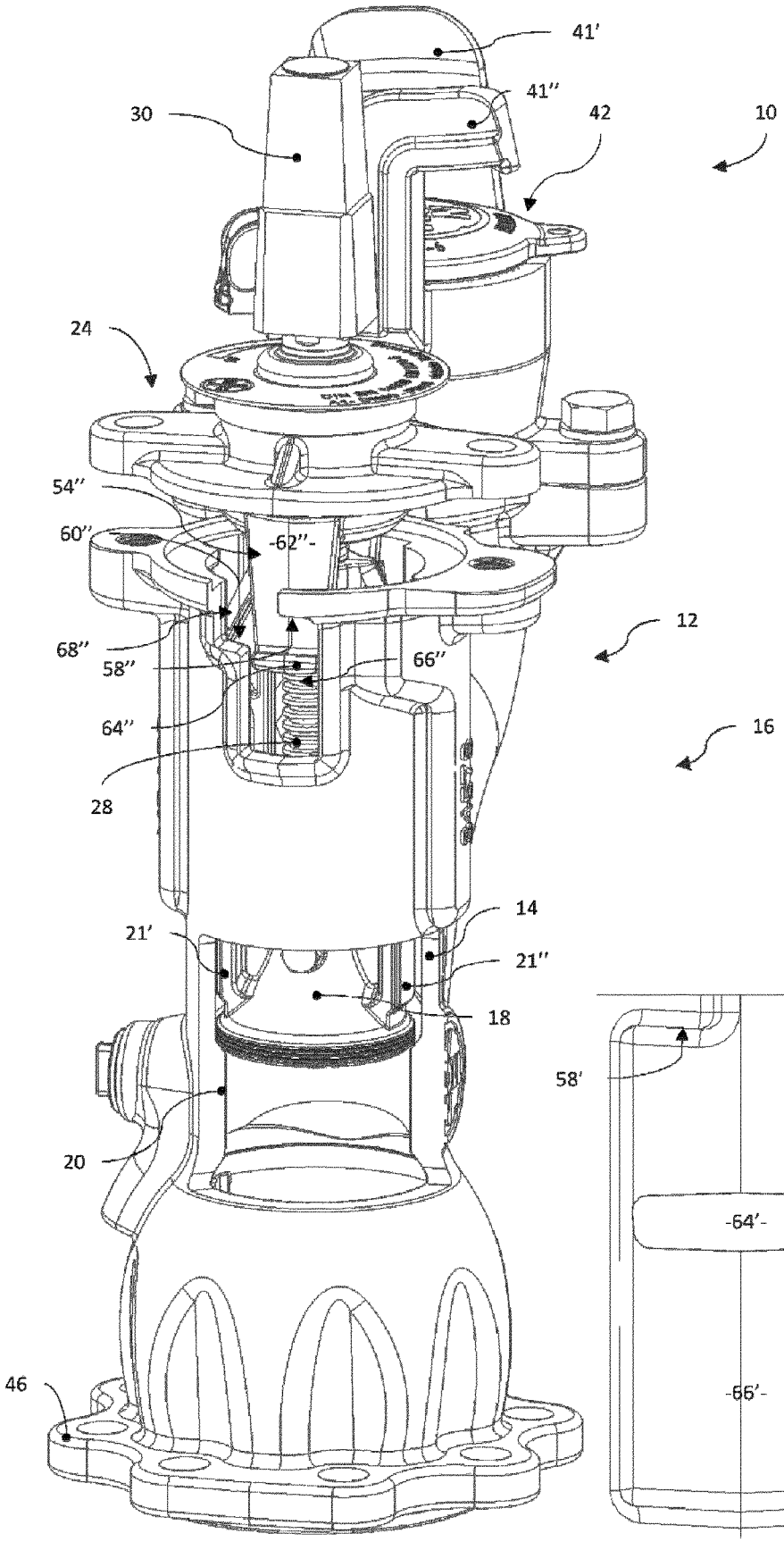
Figure 7B:
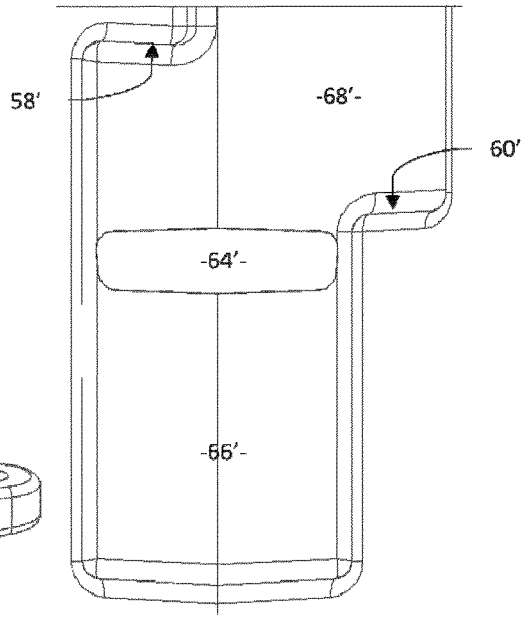
Figure 8A:
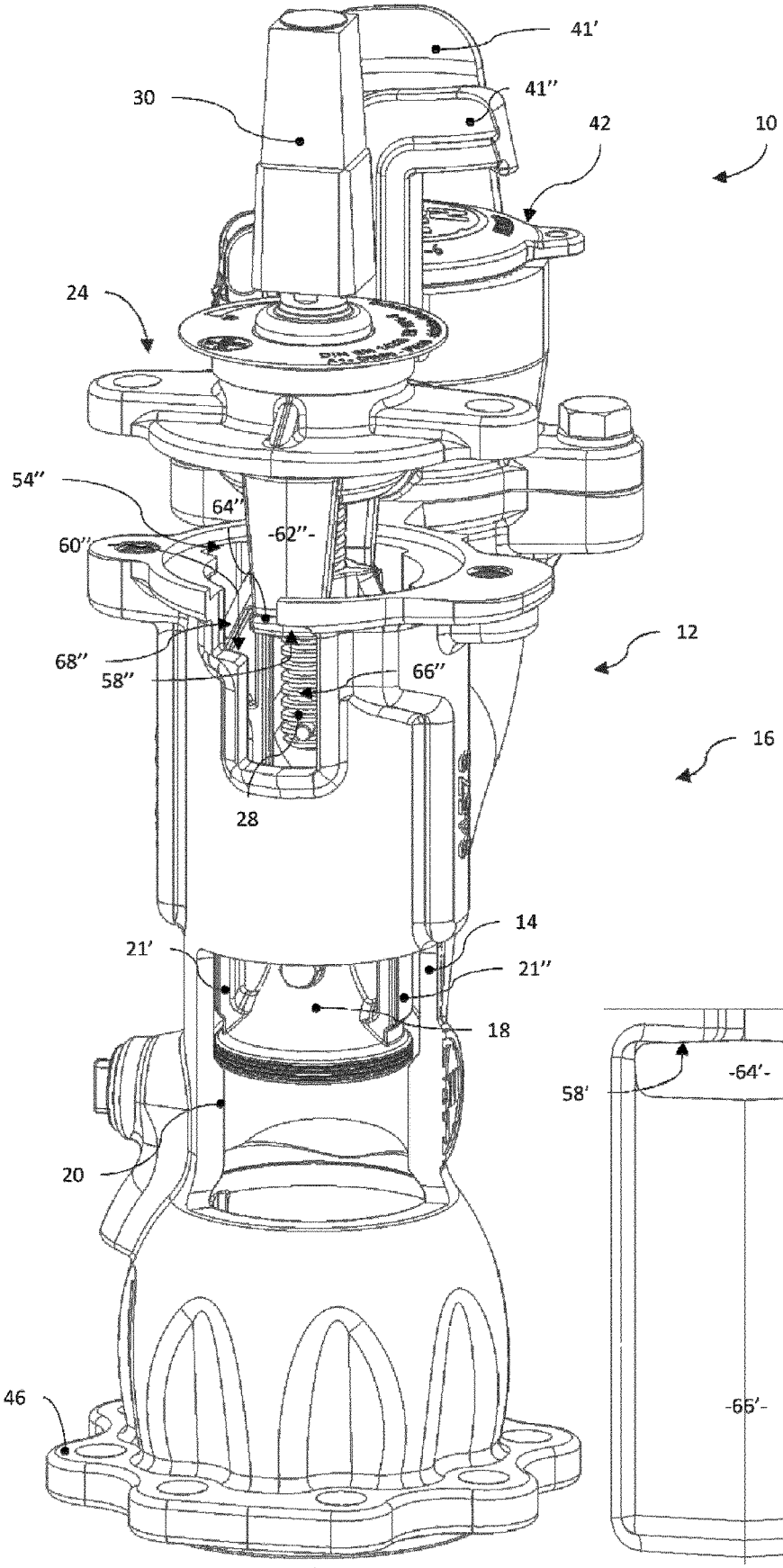
Figure 8B:
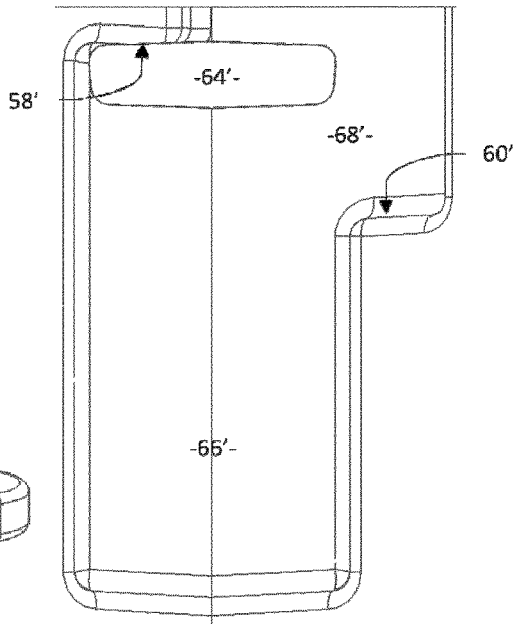
Figure 9:
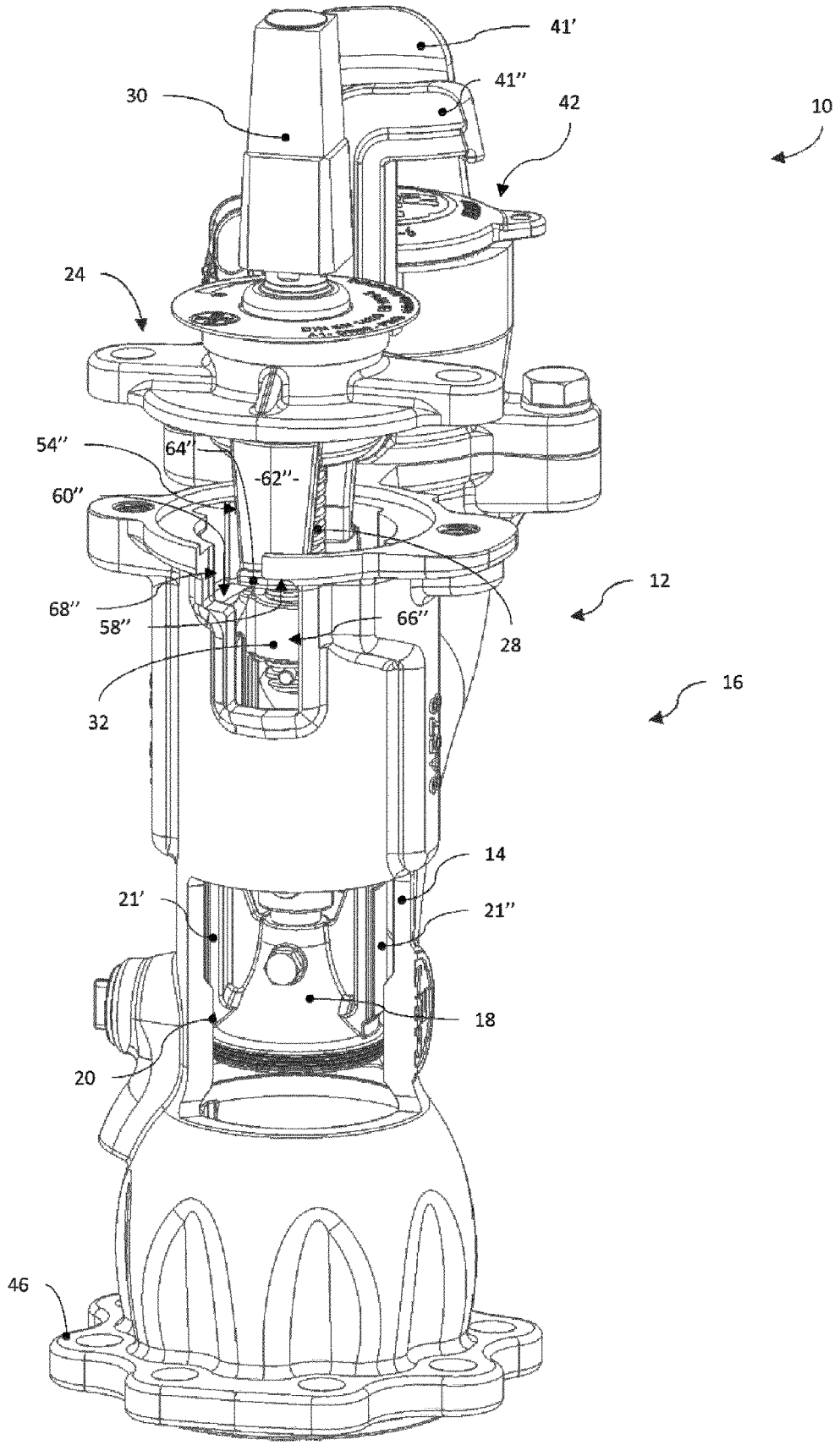

FIGS. 5*a,b* show a view according to FIGS. 2*a, b* to explain a procedure for removing the spindle assembly from the hydrant, wherein, compared to the illustration in FIGS. 4*a, b*, a projection of a journal of the spindle cover is brought to bear against a second support formed in the riser pipe and a force is applied to said second support by rotating the spindle, as a result of which the main valve body is raised in counter-reaction, FIG. 6 shows a view according to FIGS. 2*a, b*, wherein the spindle assembly is shown taken out of the riser pipe in the upward direction, FIGS. 7*a,b* show a view according to FIGS. 2*a, b* to explain a procedure for installing the spindle assembly in the hydrant, wherein the projection of the journal of the spindle cover engages in the first guide section and is aligned with a first support formed in the riser pipe, FIGS. 8*a, b* show a view according to FIGS. 2*a, b* to explain a procedure for installing the spindle assembly in the hydrant, wherein, compared to the illustration in FIGS. 7*a, b*, the projection of the journal of the spindle cover is brought to bear against the first support and a force is applied to the latter or introduced into the latter by rotating the spindle, as a result of which the main valve body is lowered in counter-reaction, FIG. 9 shows a view according to FIGS. 2*a, b* to explain a procedure for installing the spindle assembly in the hydrant, wherein, compared to FIGS. 8*a, b*, the main valve body is lowered, by rotating the spindle, to such an extent that the main valve body sealingly fits into a sealing seat of the hydrant.

FIG. 1 shows an underground hydrant 10 in a longitudinal sectional view. FIGS. 2*a, b* to FIG. 6 show procedures to explain a removal of a spindle assembly 12 from the underground hydrant 10. FIGS. 7*a, b* to FIG. 9 show procedures to explain an installation of the spindle assembly 12 in the underground hydrant 10.

The hydrant 10 comprises a riser pipe 14 and a main valve 16. The main valve 16 comprises a main valve body 18 which can be brought into sealing contact with a sealing seat 20 formed in the riser pipe 14. In the region of the sealing seat 20, the main valve body 18 is reliably axially guided by vanes 21', 21" integrally formed on the main valve body 18. In the embodiment shown, the hydrant 10 is opened by moving the main valve body 18 downward in the direction of a dead space, this movement being reliably axially guided by the vanes 21', 21". Conversely, to close the hydrant, the main valve body 18 is moved upward.

The main valve 16 additionally comprises a valve rod 22, which is fixedly connected at the lower end to the main valve body 18. The main valve 16 also comprises the spindle assembly 12. The spindle assembly 12 comprises a spindle cover 24, which can be fastened to the riser pipe 14 by way of screws 26', 26". The spindle assembly 12 additionally comprises a spindle 28, which is rotatably mounted on the spindle cover 24. A coupling element 30, for example an operating square, projects outward beyond the spindle cover 24 on the outside of the hydrant 10 and is coupled to the spindle 28 for co-rotation therewith. The spindle 28 is in thread engagement: with a spindle nut 32. The spindle nut 32 is coupled to the upper end of the valve rod 22 via a coupling/guide assembly 34, designed to convert a torque applied to the spindle 28 into an axial movement of the valve rod 22. The coupling/guide assembly 34 includes an extension 36 directed outward in a radial direction, which extension engages in a longitudinal groove 38 formed in the interior of the riser pipe 14 and can be guided therein only in the axial direction of the riser pipe 14. As a result, the coupling/guide assembly 34 and thus the valve rod 22 coupled thereto can be moved only in the axial direction of the riser pipe 14.

The hydrant 10 additionally comprises, on its outlet side, a hose coupling 40 for coupling to e.g. a hose (not shown) via e.g. two claws 41', 41". The hose coupling 40 may be sealed off from the outside by a closure cover 42. Furthermore, the hose coupling 40 may be provided with a backflow preventer 44. The hydrant 10 may be connected in a fluid-tight manner to a water inlet (not shown) via a flange 46 on the underside with an interposed seal 48. A bulbous section on the underside of the hydrant 10 defines a dead space 50 between the main valve body 18 and the water inlet.

In one embodiment of the hydrant 10 according to the invention, the spindle assembly 12 is additionally provided with a journal/journal support assembly 52. The journal/journal support assembly 52 comprises two journals 54', 54", which are attached to or formed on the spindle cover 24 in a manner offset from each other by 180°, and two journal support assemblies 56', 56" which are provided in the riser pipe 14 and are likewise offset from each other by 180°, each journal support assembly comprising a first support 58', 58" and a second support 60', 60". The first support 58', 58" and the second support 60', 60" are offset from each other as viewed in the axial direction of the riser pipe 14, so that the journals 54', 54" can be brought to bear against the first support 58', 58" from below and can be brought to bear against the second support 60', 60" from above.

The journals 54', 54" are substantially L-shaped, each comprising a web 62', 62" and a projection 64', 64" adjoining said web at the distal end, the projections projecting outward as viewed in the radial direction of the spindle cover 24. The projections 64', 64" can each be brought to bear against the first support 58', 58" and the second support 60', 60".

The journals 54', 54" can be guided via their projections 64', 64" in corresponding journal guides which are formed in the riser pipe 14. The journal guides each comprise a first guide section 66', 66", in which the journals 54', 54" can be guided in the axial direction of the spindle 28, the first guide section 66', 66" being at least partially bounded in the upward direction by the first support 58', 58". The journal guides also each comprise a second guide section 68', 68", in which the journals 54', 54" can likewise be guided in the axial direction of the spindle 28, the second guide section 68', 68" being at least partially bounded in the downward direction by the second support 60', 60".

The first guide section 66', 66" and the second guide section 68', 68" are at least partially offset from each other, wherein they may be at least partially overlapped in a region between the first support 58', 58" and the second support 60', 60". This arrangement enables the spindle cover 24 to be partially turned, namely via its journals 54', 54", which can be guided from the first guide section 66', 66" into the second guide section 68', 68" and vice versa.

Procedures for removing the spindle assembly 12 and thus the main valve 16 from the hydrant 10 will be explained below.

Starting from the starting position shown in FIGS. 2*a, b*, the screws 26', 26" are removed, as shown in FIGS. 3*a, b*. The spindle 28 is then rotated by applying a torque to the coupling element 30 in a direction in which the spindle cover 24 is raised, for example in the counterclockwise (CCW) direction. The spindle cover 24 advantageously does not rotate therewith, since it is guided by the projections 64', 64" engaging in the first guide section 66', 66".

As a result of the rotation, the spindle cover 24 is raised so far until the projections 64', 64" of the journals 54', 54" are in a region at the height between the first support 58', 58" and the second support 60', 60' or reach the section in which the first guide section 66', 66" and the second guide section 68', 68" overlap. By way of example, as a result of the rotation, the spindle cover 24 can be raised so far until the projections 64', 64" butt against the first support 58', 58" (see FIG. 3*b*). The main valve body 18 remains in an unchanged position.

Starting from this position, the projections 64', 64" are transferred from the first guide section 66', 66" to the second guide section 68', 68", as shown in FIGS. 4*a, b*. To this end, the spindle 28 is simply rotated in the opposite direction, for example in the clockwise (CW) direction. As a result of e.g. friction between the spindle cover 24 and the spindle 28, the spindle cover 24 also rotates by the applied rotation, so that the spindle cover 24 does not have to be turned by hand. The projections 64', 64" are now partially aligned with the second support 60', 60".

Starting from this position, the spindle is rotated further in the same direction of rotation, as shown in FIGS. 5*a, b*. In doing so, the spindle cover 24 is lowered and the projections 64', 64" come into contact with the second support 60', 60". The rotation continues in the same direction, with the force thus generated being introduced into the second support 60', 60" via the projections 64', 64". In counter-reaction, as the rotation of the spindle 28 continues, the spindle nut 32 coupled thereto by a thread is moved upward, and as a result the main valve body 18 is steadily raised in a manner guided via the valve rod 22. In doing so, the main valve body 18 is pulled out of sealing contact with the sealing seat 20. As soon as the main valve body 18 is freed from sealing contact with the sealing seat 20, the spindle assembly 12 and/or the main valve 16 can be taken out of the riser pipe 14 in the upward direction, as illustrated in FIG. 6.

Procedures for installing the spindle assembly 12 and thus the main valve 16 in the hydrant 10 will be explained below with reference to FIGS. 7*a, b* to 9.

For installation purposes, the spindle assembly 12 and/or the main valve 16 is inserted into the guide section by way of the spindle cover 24. To this end, the journals 54', 54" are inserted via their projections 64', 64" into the first guide section 66', 66". As soon as the projections 64', 64" are at the height in said section at which the first guide section 66', 66" and the second guide section 68', 68" overlap, the spindle cover 24 is turned, for example in the counterclockwise (CCW) direction, and then is lowered further in a manner guided by the second guide section 68', 68". In this position, the projections 64', 64" are partially aligned with the first support 58', 58". In this position, the main valve body 18 can e.g. come into contact with the sealing seat 20 from above.

Starting from this position, the spindle 28 is rotated in a direction to raise the spindle cover 24, for example in the counterclockwise (CCW) direction, until the projections 64', 64" come to bear against the first support 58', 58", as shown in FIGS. 8*a, b*. In this position, the spindle 28 is rotated further in the same direction of rotation. The force thus generated is introduced into the first support 58', 58". As rotation of the spindle 28 continues, the spindle nut 32 is moved downward in counter-reaction, and the main valve body 18 is thus pushed or pressed into the sealing seat 20, as shown in FIG. 9. As soon as the main valve body 18 is located fully in the sealing seat 20 or has assumed a predetermined position in the sealing seat 20, the spindle 28 is not rotated any further. By way of example, in this position, the spindle 28 can be rotated until it stops, which can serve as an indication that the main valve body 18 is located fully in the sealing seat 20.

Starting from this position, the spindle 28 is rotated in the opposite direction, for example in the clockwise (CW) direction, to lower the spindle cover 24. It may initially be necessary to prevent the spindle cover 24 from rotating or turning here, for example by using a hand. As soon as the spindle cover 24 is guided by the projections 64', 64" of the journals 54', 54" engaging in the first guide section 66', 66", the spindle cover 24 no longer has to be prevented from rotating. The rotation of the spindle 28 is continued until the spindle cover 24 butts against the riser pipe 14. Once this position has been reached, the spindle cover 24 is screwed to the riser pipe 14 by way of the screws 26', 26". The hydrant is then back in the starting position shown in FIG. 2*a*.

The invention claimed is:

1. A hydrant (10), comprising:
- a riser pipe (14); and
- a main valve (16), the main valve (16) having:
  - a main valve body (18),
  - a sealing seat (20) which can be sealed by the main valve body (18),
  - a valve rod (22) which is connected at one end to the main valve body (18), and
  - a spindle assembly (12), wherein the spindle assembly (12) comprises:
    - a spindle cover (24) which can be fastened to the riser pipe (14),
    - a spindle (28) which is rotatably mounted on the spindle cover (24),
    - a spindle nut (32) which is coupled to the valve rod (22) at another end of the valve rod (22), wherein the spindle (28) and the spindle nut (32) are in thread engagement with each other, designed to convert a torque applied to the spindle (28) into an axial movement of the valve rod (22), and
    - a journal/journal support assembly (52), comprising at least one journal (54',54") and at least one journal support (56',56"), wherein the journal support (56',56") comprises a first support (58',58") and a second support (60',60"), against each of which the journal (54',54") can be brought to bear, wherein the journal (54',54") is directly attached to the spindle cover (24) in a rotationally fixed manner, and the journal support (56',56") is provided in the riser pipe (14).

2. The hydrant (10) according to claim 1, wherein the first support (58',58") and the second support (60',60") are offset from each other.

3. The hydrant (10) according to claim 1, wherein the journal (54',54") can be brought to bear against the first support (58',58") from below and the journal (54',54") can be brought to bear against the second support (60',60") from above.

4. The hydrant (10) according to claim 1, wherein the riser pipe (14) is provided with a journal guide, in which the journal (54',54") can be guided, wherein the journal guide comprises:
- a first guide section (66',66"), in which the journal (54', 54") can be guided in the axial direction of the spindle (28), wherein the first guide section (66',66") is at least partially bounded in the upward direction by the first support (58',58"), and
- a second guide section (68',68"), in which the journal (54',54") can be guided in the axial direction of the spindle (28), wherein the second guide section (68',68")

is at least partially bounded in the downward direction by the second support (60',60").

5. The hydrant (10) according to claim 4, wherein the first (66',66") and second (68',68") guide sections are at least partially offset from each other.

6. The hydrant (10) according to claim 4, wherein the first (66',66") and second (68',68") guide sections are at least partially overlapped in a section between the first (58', 58") and the second (60', 60") support.

7. The hydrant (10) according to claim 4, wherein the journal guide in the riser pipe (14) is designed as a cutout.

8. The hydrant (10) according to claim 1, wherein the journal (54',54") is substantially L-shaped, comprising a projection (64',64") which is directed outward as viewed in the radial direction of the spindle cover (24), wherein the projection (64',64") can be brought to bear against the first (58',58") and second (60',60") support.

9. The hydrant (10) according to claim 8, wherein the projection (64',64") engages in a journal guide.

10. The hydrant (10) according to claim 1, wherein the riser pipe (14) is open in the upward direction in a region of a second guide section (68',68").

11. The hydrant (10) according to claim 1, wherein the spindle cover (24) can be screwed onto the riser pipe (14).

* * * * *